US006739664B2

(12) United States Patent
Kinoshita et al.

(10) Patent No.: US 6,739,664 B2
(45) Date of Patent: May 25, 2004

(54) CHAIR

(75) Inventors: Yojiro Kinoshita, Osaka (JP); Nobuyuki Ueda, Osaka (JP); Toshiyuki Horiki, Nagano (JP); Kazuyuki Itoh, Nagano (JP)

(73) Assignees: Kokuyo Co., Ltd. (JP); Takano Co., Ltd. (JP)

( * ) Notice: Subject to any disclaimer, the term of this patent is extended or adjusted under 35 U.S.C. 154(b) by 0 days.

(21) Appl. No.: 10/130,745

(22) PCT Filed: Oct. 3, 2001

(86) PCT No.: PCT/JP01/08734

§ 371 (c)(1),
(2), (4) Date: May 23, 2002

(87) PCT Pub. No.: WO02/32266

PCT Pub. Date: Apr. 25, 2002

(65) Prior Publication Data

US 2002/0190554 A1 Dec. 19, 2002

(30) Foreign Application Priority Data

Oct. 16, 2000 (JP) ..... 2000-314986
Oct. 16, 2000 (JP) ..... 2000-315744

(51) Int. Cl.[7] ..... A47C 1/024; B60N 2/02

(52) U.S. Cl. ..... 297/300.3; 297/300.4; 297/301.2; 297/301.3; 297/302.2; 297/354.12; 297/362.13

(58) Field of Search ..... 297/301.2, 301.3, 297/300.3, 300.4, 302.2, 362.13, 354.12

(56) References Cited

U.S. PATENT DOCUMENTS

| | | | | | |
|---|---|---|---|---|---|
| 4,270,797 | A | * | 6/1981 | Brauning | 297/300.3 |
| 4,720,142 | A | * | 1/1988 | Holdredge et al. | 297/301.7 |
| 5,024,484 | A | * | 6/1991 | Buchacz | 297/300.3 |
| 5,100,201 | A | * | 3/1992 | Becker et al. | 297/301.3 |
| 5,385,388 | A | * | 1/1995 | Faiks et al. | 297/301.3 |
| 6,074,008 | A | * | 6/2000 | Gorgi et al. | 297/376 |
| 6,149,236 | A | * | 11/2000 | Brauning | 297/301.2 |
| 6,161,897 | A | * | 12/2000 | Kurtz et al. | 297/321 |

FOREIGN PATENT DOCUMENTS

| | | |
|---|---|---|
| JP | 6-49432 B2 | 6/1994 |
| JP | 6-28036 Y2 | 8/1994 |
| JP | 7-29873 Y2 | 7/1995 |
| JP | 10-179314 A | 7/1998 |

* cited by examiner

*Primary Examiner*—Peter M. Cuomo
*Assistant Examiner*—Sarah Burnham
(74) *Attorney, Agent, or Firm*—Banner & Witcoff Ltd.

(57) ABSTRACT

A chair 1 allowing a person sitting thereon to move a part of the person's body above the waist which corresponds to the backrest of the chair is provided having a backrest portion located behind a seat portion, the backrest portion being divided into backrest upper frames 55 and backrest lower frames 50, wherein a first state which allows the whole backrest frame 5 to incline rearwardly and a second state which allows the backrest upper frames 55 to incline rearwardly relative to the backrest lower frames 50 are assumed, the first state and the second state being switchable to each other.

2 Claims, 9 Drawing Sheets

CHAIR

CROSS REFERENCE TO RELATED APPLICATIONS

This is a U.S. National Phase Application under 35 U.S.C. § 371 and applicant herewith claims the benefit of priority of PCT/JP01/08734 filed Oct. 3, 2001, which was published Under PCT Article 21(2) in Japanese, which claims priority to Japanese Application Nos. P2000-315744, filed Oct. 16, 2000 and P2000-314986, filed Oct. 16, 2000, the entire contents of which are incorporated herein by reference.

TECHNICAL FIELD

The present invention relates to chair structures, for example to a chair offering a sitting comfort that is suitable for operations in an office or the like.

BACKGROUND ART

Conventionally, there exist chairs of the type which is capable of rearwardly inclining a whole backrest portion as chairs for use in offices or the like. Usually, the backrest portion of such a chair is inclined rearwardly by releasing a lever provided under the seat, pressing the backrest portion rearwardly and returning the lever to its original position at a desired angle of inclination to make the backrest portion stationary.

Since such a chair is configured to allow its whole backrest portion to incline rearwardly, the chair involves a problem that the shoulders of a person sitting on the chair come to abut a frame portion of the chair and hence are restrained from moving when the sitting person wants to be refreshed by stretching his or her back or when the need arises to bend the upper part of his or her body rearward as in the case where the sitting person is going to pick up baggage placed behind by turning the shoulders with the chair kept in an upright state.

Accordingly, it is an object of the present invention to provide a chair which allows a person sitting thereon to freely move the upper part of his or her body, thereby resolving the foregoing problem.

DISCLOSURE OF INVENTION

To resolve the foregoing problem, the present invention provides a chair capable of switching between a state that allows a whole backrest portion thereof to incline rearwardly and a state that allows an upper part of the backrest portion to incline rearwardly relative to a lower part of the backrest portion.

With such a construction, a person sitting on the chair can selected a desired one of the state allowing the sitting person to stretch his or her whole body for relaxing and the state allowing the sitting person to free a part of his or her body adjacent the shoulders by inclining the upper part of the backrest portion rearwardly relative to the lower part thereof. Adoptable methods of rearwardly inclining the upper part of the backrest portion include: a method such as to incline the upper part of the backrest portion rearwardly with the lower part of the backrest portion kept in an upright position; a method such as to incline the whole backrest portion rearwardly and then incline only the upper part of the backrest portion further rearwardly; and like methods.

In the case of the arrangement that allows the whole backrest portion to incline rearwardly, if a seat portion is also allowed to incline rearwardly at the same time, the chair allows a person to sit thereon more deeply when the whole backrest portion is inclined, thereby offering a better sitting comfort.

Among such inventions, the invention that allows the upper part of the backrest portion to incline rearwardly with the lower part of the backrest portion fixed in an upright position, allows the sitting person to largely bend the backbone rearwardly, thereby making the sitting person more refreshed.

In the arrangement that allows the upper part of the backrest portion to incline rearwardly, if a part of the backrest portion above the waist of the sitting person is allowed to incline rearwardly, the chair allows the sitting person to bend his or her whole backbone as well as the neck portion rearwardly.

Further, such a construction is possible that the chair comprises a link member rotatably mounted on a support base, a backrest frame rotatably connected to the link member, and a pin removably inserted though holes that are defined in the link member and the backrest frame, respectively, wherein the link member and the backrest frame become rotatable as an integral part when the pin is inserted through the two holes, while when the pin is pulled out of one of the two holes, the backrest frame becomes independently rotatable.

With such a construction, it is possible to allow the link member and the backrest frame to incline rearwardly as an integral part by inserting the pin through the holes thereof or to allow the upper part of the backrest frame to relatively incline rearwardly independently of the link member by pulling the pin out of one hole. The chair of this construction allows a person sitting thereon to stretch his or her whole body to relax the whole body as well as to bend the backbone reversely thereby making the sitting person refreshed. Adoptable methods of inclining the upper part of the backrest portion include: a method such as to incline the upper part of the backrest portion rearwardly with the lower part of the backrest portion kept in an upright position; and a method such as to incline the whole backrest portion rearwardly and then incline only the upper part of the backrest portion further rearwardly.

BEST MODE FOR CARRYING OUT THE INVENTION

First Embodiment

Figure 1:
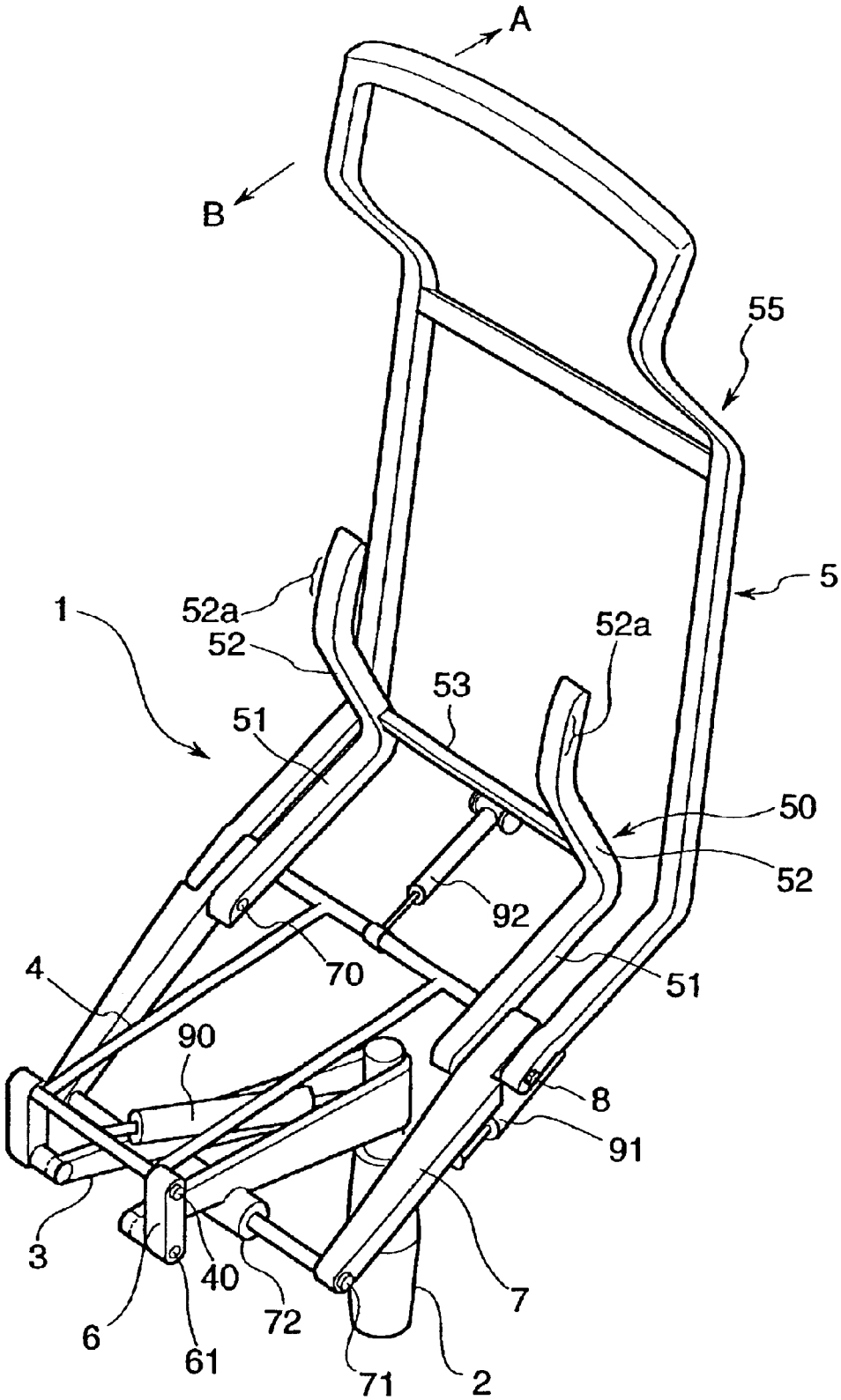
FIG. 1 is a perspective view showing a chair according to a first embodiment of the present invention.

Hereinafter, one embodiment of the present invention will be described with reference to the drawings. FIG. 1 is a perspective view showing a principal part of a chair 1 according to one embodiment of the present invention. The chair 1 includes a support base 3 mounted on a base leg 2, links 6 and 7 attached to the support base 3, a seat frame 4 forming a seat portion and attached to the links 6 and 7, and a backrest frame 5 comprising backrest upper frames 55 and backrest lower frames 50. The chair 1 further comprises other appropriate members such as a cover and a cushion.

The support base 3 is constructed of an aluminum member shaped into an inverted triangle and has a lower side attached to the base leg 2 and an inclined side fitted with the links 6 through shafts 61 at a front end portion thereof. The links 6 are configured to be rotatably movable by means of a shaft 40 and shafts 61 located on opposite sides of a front portion of the seat frame 4. Between the shaft 40 located at the upper end of the links 6 and a central portion of the support base 3 is provided a gas spring 90 which can be switched between a fixed state and a free state to vary the inclination of the backrest frame 5 by means of a lever not shown. A torsion bar 72 is provided in a substantially central portion of the inclined side of the support base 3 and each link 7 is fixed at its one end to a shaft 71 extending in the direction of an extension of the torsion bar 72. Each link 7 is constructed of a metal member extending obliquely rearwardly and is rotatably connected at its other end to a rear frame of the seat frame 4. The force of the torsion bar 72 biases the links 7 so that the shaft 8 side of each link 7 rotates forwardly of the chair 1 (toward the side B).

On the underside of an upper portion of the links 7 is provided a gas spring 91 connected to the backrest upper frames 55, the gas spring 191 constantly biasing the backrest upper frames 55 forwardly (toward the side B) by means of its gas pressure. In the vicinity of the gas spring 91 is provided a mechanism for pinching and fixing a shaft of the gas spring 91 and, hence, the gas spring 91 can be switched between a free state and a fixed state when a lever not shown is operated.

Inside the backrest upper frames 55 thus mounted through the shafts 8 are rotatably mounted the backrest lower frames 50 though shafts 70 attached to the links 7. The backrest lower frames 50 each comprises an ischium—corresponding frame 51 extending substantially in the direction of an extension of the corresponding link 7, and a hipbone—corresponding frame 52 upwardly extending substantially perpendicularly from the ischium—corresponding frame 51, the hipbone—corresponding frame 52 having a leading end portion formed with an arcuately curved portion 52*a*curved toward the rear side of the chair 1 (toward the side A). The ischium—corresponding frames 51 are provided with a connection member 53 interconnecting these right and left frames. A gas spring 92 is provided between the connection member 53 and the rear frame located on the rear side of the seat frame 4. In this embodiment, the gas spring 92 is constantly kept in a fixed state.

The backrest upper frames 55 attached to the shafts 8 becomes rotatable about the shaft 71 together with the links 7 as an integral part when the gas spring 91 located on the underside of the backrest upper frames 55 is switched to the fixed state. Alternatively, when the gas spring 91 is switched to the free state, the backrest upper frames 55 become rotatable about the. shafts 8. Each of the backrest upper frames 55 has a lower portion bent upwardly like each backrest lower frame 50 and extends behind the backrest lower frame 50 from the bent portion up to a level adjacent the shoulders of a person sitting on the chair 1.

The backrest lower frames 50 and backrest upper frames 55 are attached with cantilever elastic pieces not shown so that their free ends face opposite to each other and further with an upholstery member in a manner to embrace the elastic pieces to form a human body contacting surface of the backrest portion.

Figure 3:
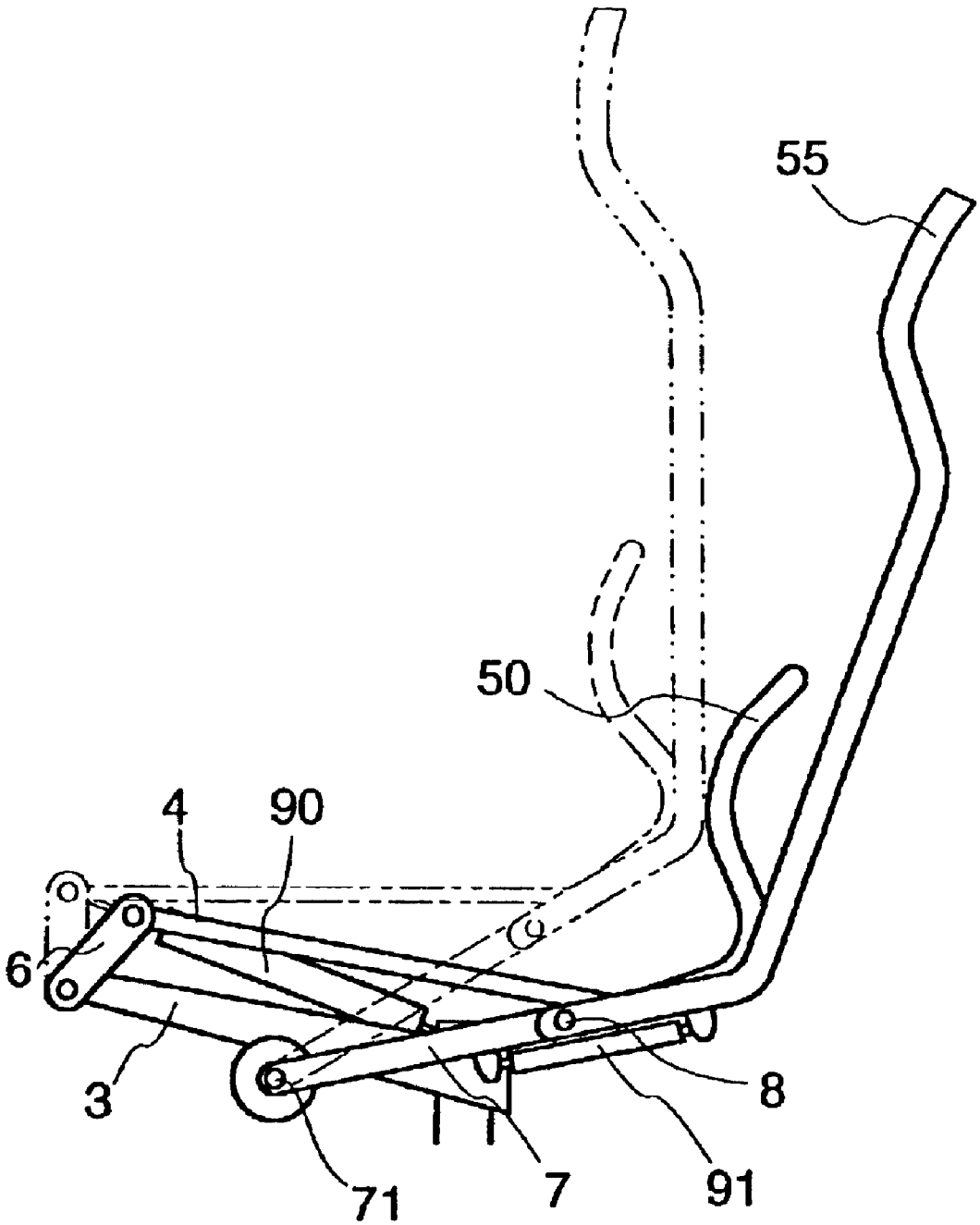
FIG. 3 is a side view showing a first state of the chair according to the first embodiment.

Next, description is directed to switching of the state of the backrest of the chair thus constructed. Described first is the case where a first state (shown in FIG. 3) is to be assumed which allows the backrest lower frames 50 and the backrest upper frames 55, as an integral part, are rearwardly inclined in the direction A with the seat frame 4 moving interlockingly therewith.

Figure 2:
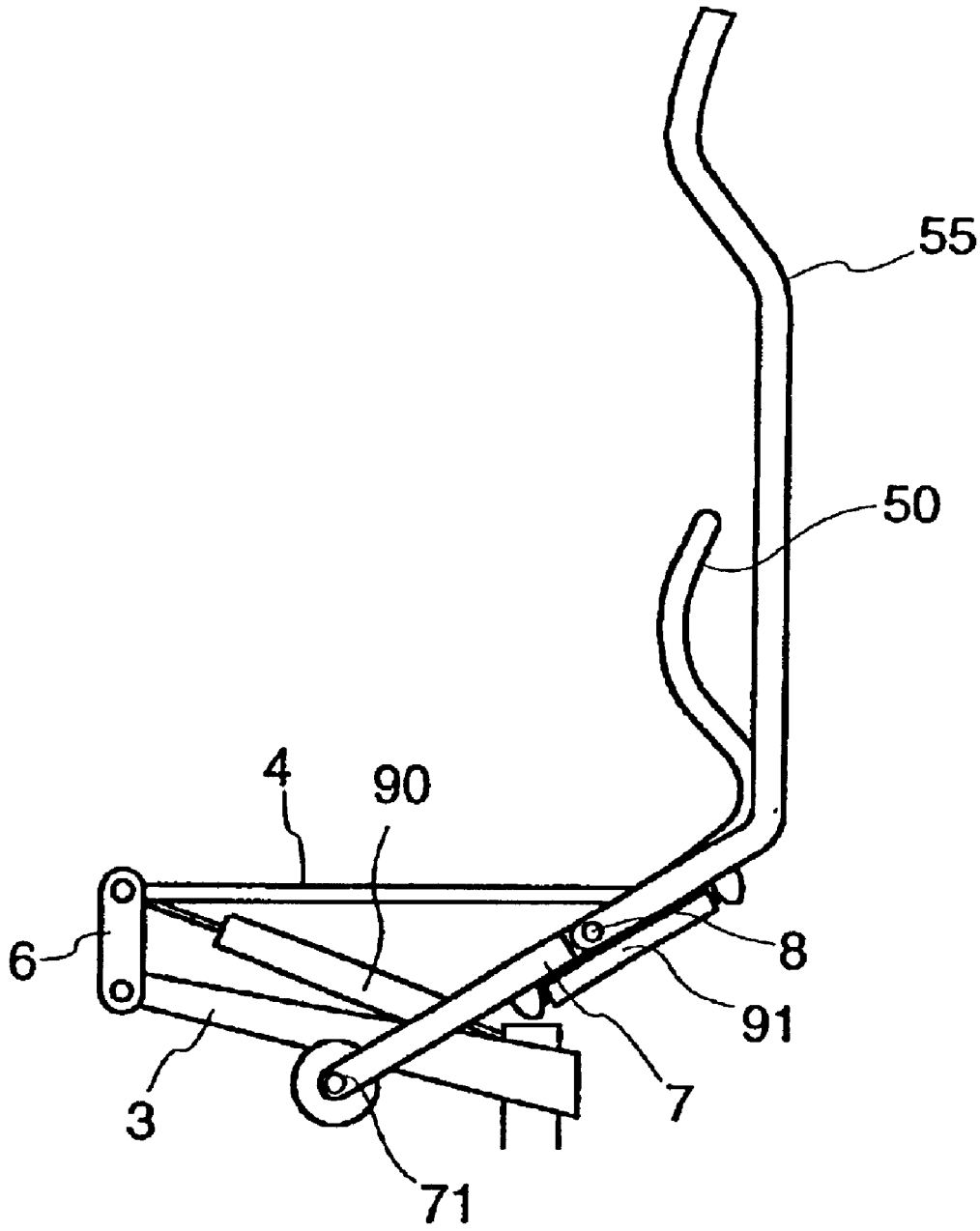
FIG. 2 is a side view of the chair in an upright position according to the first embodiment.

In switching a state (shown in FIG. 2) where the backrest lower frames 50 and the seat frame 4 are in the upright position of the chair (namely, a state where a person does not sit on the chair while the gas spring 90 is made free) to the first state (shown in FIG. 3) allowing the whole backrest frames 5 to incline rearwardly, the gas spring 91 is turned into a fixed state, while the gas spring 90 is made free. By so doing, the backrest upper frames 55 together with the links 7, as an integral part, become capable of largely rotating about the shaft 71. Further, since the gas spring 90 assumes a free state, a four member link mechanism comprising the support base 3, links 6, seat frame 4 and links 7 causes the seat frame 4 to incline rearwardly. In cooperation therewith, the backrest lower frames 50 also incline as the links 7 rotate and, hence, the seat frame 4 and the backrest frame 5 move synchronously as a whole.

Figure 4:
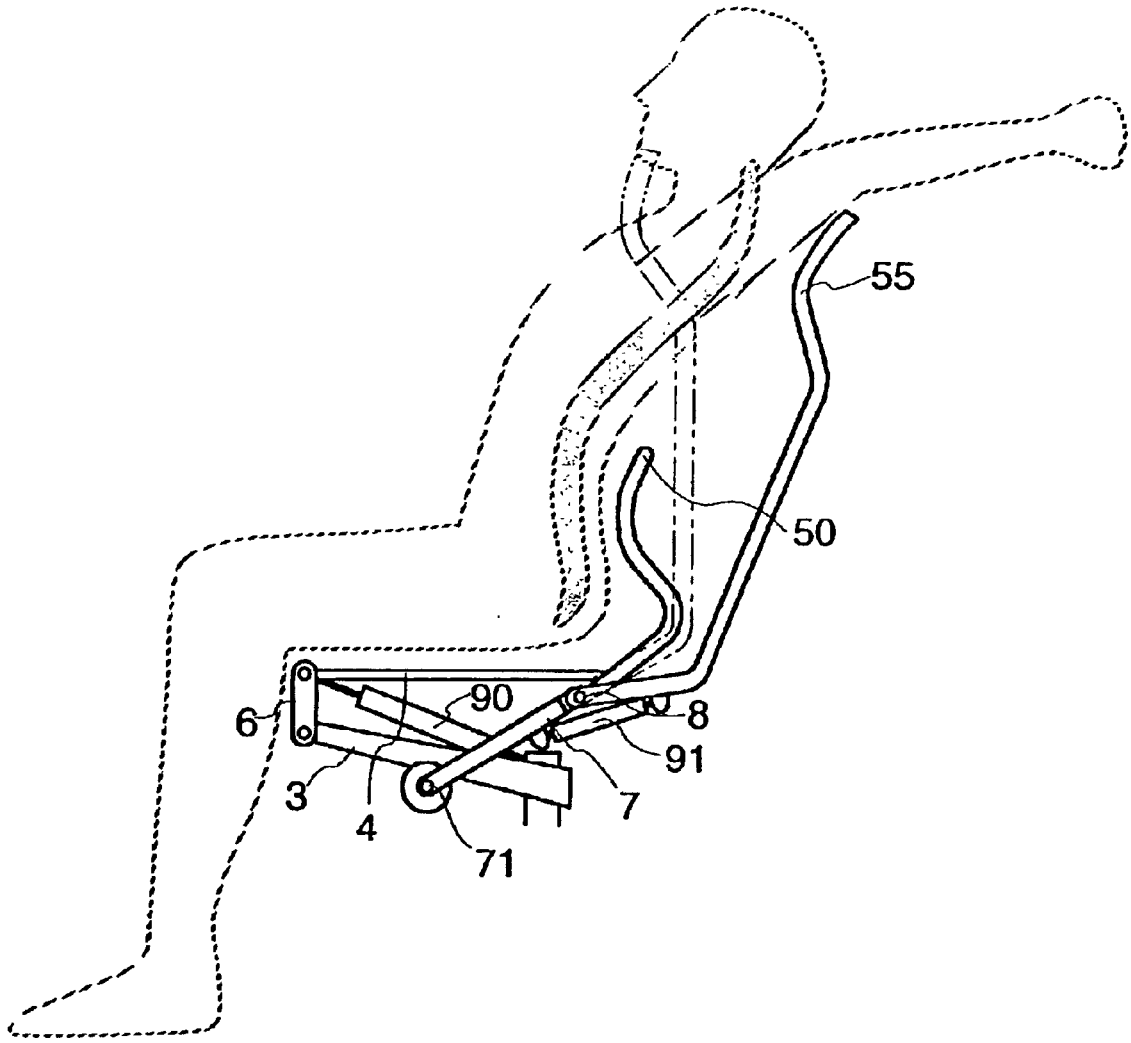
FIG. 4 is a side view showing a second state of the chair according to the first embodiment.

Alternatively, in switching the state (shown in FIG. 2) where the backrest lower frames 50 and the seat frames 4 are in the upright position of the chair to the second state (shown in FIG. 4) allowing the backrest upper frames 55 to incline rearwardly, the gas spring 91 is turned into the free state, while the gas spring 90 located below the seat frame 4 is turned into the fixed state. By so doing, the seat frame 4 and the backrest lower frame 50 are fixed in the upright position of the chair, while only the backrest upper frames 55 become capable of rotating about the shafts 8 toward the side A.

According to this embodiment of the present invention, by dividing the backrest frame 5 located behind the seat frame 4 into the backrest upper frames 55 and the backrest lower frames 50 and switching the gas springs 90 and 91 between the fixed state and the free state it is possible to perform switching between the first state (shown in FIG. 3) that allows the whole backrest frame 6 to incline rearwardly and the second state (shown in FIG. 4) that allows only the backrest upper frames 55 to incline rearwardly with the backrest lower frames 50 fixed. Thus, a person sitting on this chair is capable of selecting a desired one of the state allowing the sitting person's whole body to relax by inclining the whole backrest portion and the state allowing the upper part of the backrest portion to relatively incline rearwardly, thereby making his or her body free on the chair. Specifically, when the first state is selected, it is possible to relax the sitting person's whole body, relieve the pressure on the internal organs of the person and enlarge the hip joints. Alternatively, when the second state is selected, it is possible to refresh the sitting person by stretching the backbone or to release the stress on the backbone.

It should be noted that the foregoing embodiment may be variously modified without departing from the spirit of the present invention. For example, the arrangement adopted in the foregoing embodiment in which the backrest lower frames 50 are located inside the backrest upper frames 55 may be reversed. Though the shaft about which the backrest upper frames 55 are rotatable is changed by switching the gas spring 91 between the fixed state and the free state in the foregoing embodiment, the present invention is not limited to this arrangement and may employ any arrangement which can interlock the backrest upper frames with the links 7 or release the interlocked state of these members.

Second Embodiment

Figure 5:
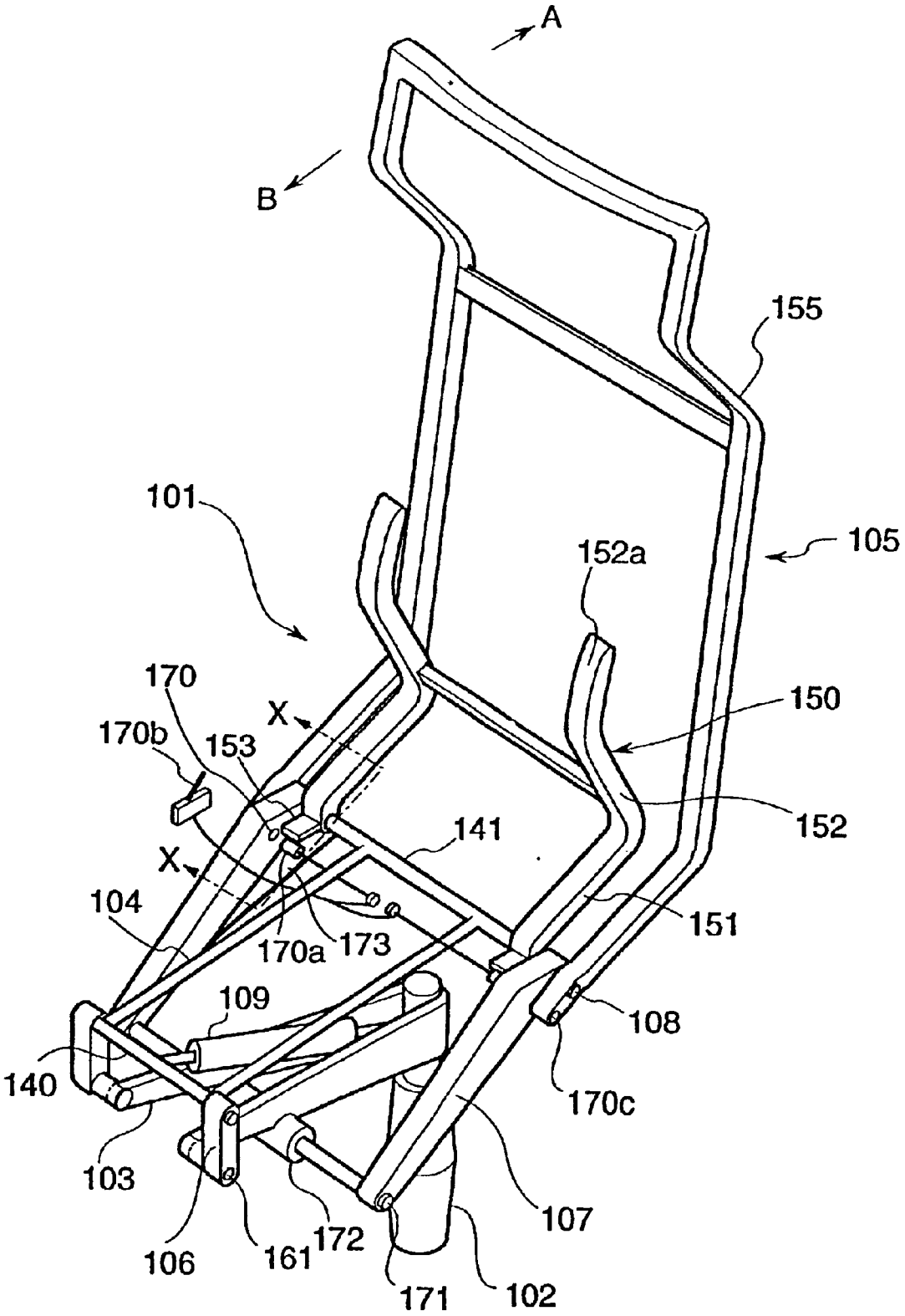
FIG. 5 is a perspective view showing a principal part of a chair according to a second embodiment of the present invention.

Hereinafter, one embodiment of the present invention will be described with reference to the drawings. FIG. 5 is a perspective view showing a principal part of a chair 101 according to one embodiment of the present invention. The chair 101 includes a support base 103 mounted on a base leg 102, links 106 attached to the support base 103, links 107 forming the link member of the present invention, a seat frame 104 forming a seat portion and attached to the links 106 and 107, and a backrest frame 105 located behind the seat frame 104. The support base 103 is provided with a gas cylinder 109 for generating an elastic force in inclining the seat frame 104 and the backrest frame 105. The chair 101 further comprises other appropriate members such as a cover and a cushion.

The support base 103 is constructed of an aluminum member shaped into an inverted triangle or a like member and has a lower side attached to the base leg 102 and an inclined side fitted with the links 106 through shafts 61 at a front end portion thereof. The links 106 are configured to be rotatably movable through the opposite sides of a front frame 140 forming part of the seat frame 104 and through the shafts 161. A torsion bar 172 is provided in a substantially central portion of the inclined side of the base leg 102 and each link 107 is fixed at its one end to a shaft 171 extending in the direction of an extension of the torsion bar 172 and rotatably connected at its other end to a shaft 108 extending from a rear frame 141 of the seat frame 104. The torsion bar 172 is configured to give a rotating force to the shaft 171 by means of a spring member and this rotating force constantly biases the links 107 so that the shaft 108 side of each link 107 rotates forwardly of the chair 101 (toward the side B).

Each link 107 defines a through-hole 170 at a substantially midpoint thereof for receiving a pin 170*a* therethrough. The pins 170*a* on opposite sides can be inserted through or pulled out of the respective through-holes 170 at a time when a lever 170*b* provided under the seat is operated. These pins 170*a* can come out of the through-holes 170 inwardly of the links 107 when a wire extending from the lever 170*b* is pulled and can be inserted through the through-holes 170 by using a spring not shown when the wire is returned into its original position. Insertion and withdrawal of the pins 170*a* may be performed using other appropriate member such as a cam.

The backrest lower frames 150 and the backrest upper frame 155 are rotatably mounted on the shafts 108 located on the upper end side of the links 107 with the links 107 sandwiched therebetween. The backrest lower frames 150 each comprises an ischium corresponding frame 151 extending substantially in the direction of an extension of the corresponding link 107, and a hipbone—corresponding frame 152 upwardly extending substantially perpendicularly from the ischium—corresponding frame 151, the hipbone—corresponding frame 52 having a leading end portion formed with an arcuately curved portion 152*a* curved toward the rear side of the chair 101 (toward the side A) thereby giving a person sitting on the chair 101 a better feeling of contact with a portion around the hipbone.

Figure 6:
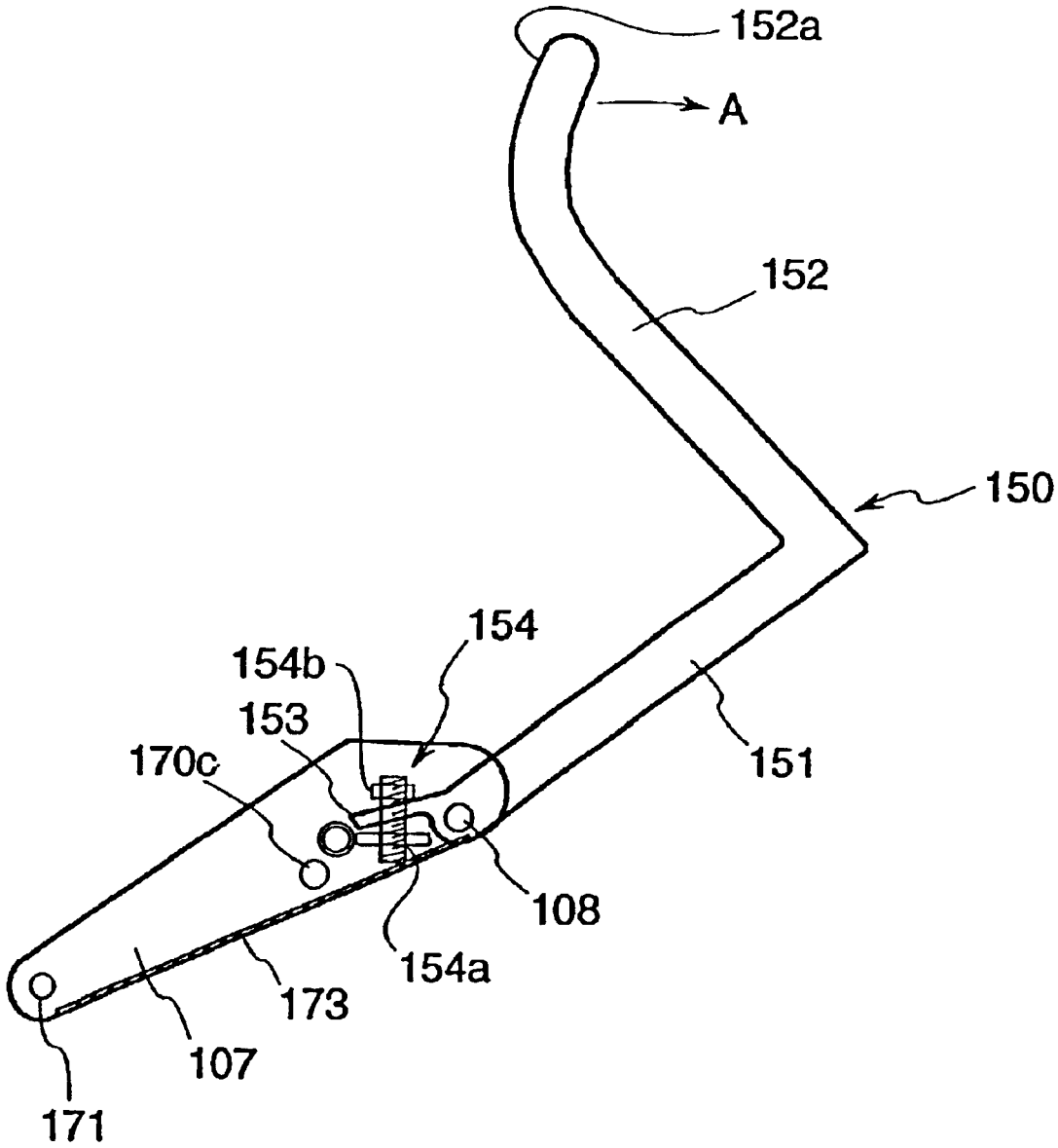
FIG. 6 shows a principal part of a section taken on line X—X in FIG. 5.

As shown in FIG. 6, each ischium—corresponding frame 151 is provided at its lower end a projecting piece 153 and a lifting mechanism 154 for lifting and lowering the projecting piece 153. By rotating a worm gear 154*a* provided on a support 173 forming part of the lifting mechanism 154 an up-down piece 154*b* is raised or lowered. Each backrest lower frame 150 is given a rotating force in the direction A by means of an appropriate spring or the like, the rotating force causing the projecting piece 153 to constantly abut the up-down piece 154*b* thereby making the backrest lower frame 150 stationary.

On the other hand, the backrest upper frames 155 on the outer sides of the opposite shafts 108 define at lower ends thereof though-holes 170*c* for receiving the pins 170*a* and become wholly rotatable about the shafts 171 located on the lower end side of the links 107 when the pins 170*a* are inserted through the respective through-holes 170*c*. Each of the backrest upper frames 155 is bent at a lower portion thereof like each backrest lower frame 150 and is constantly given a force in the direction B by means of a spring not shown or the like. The backrest upper portions 156 further extend behind the backrest lower frames 150 from their bent portions to support a part of a sitting person adjacent the shoulders at portions above their curved portions.

Figure 7:
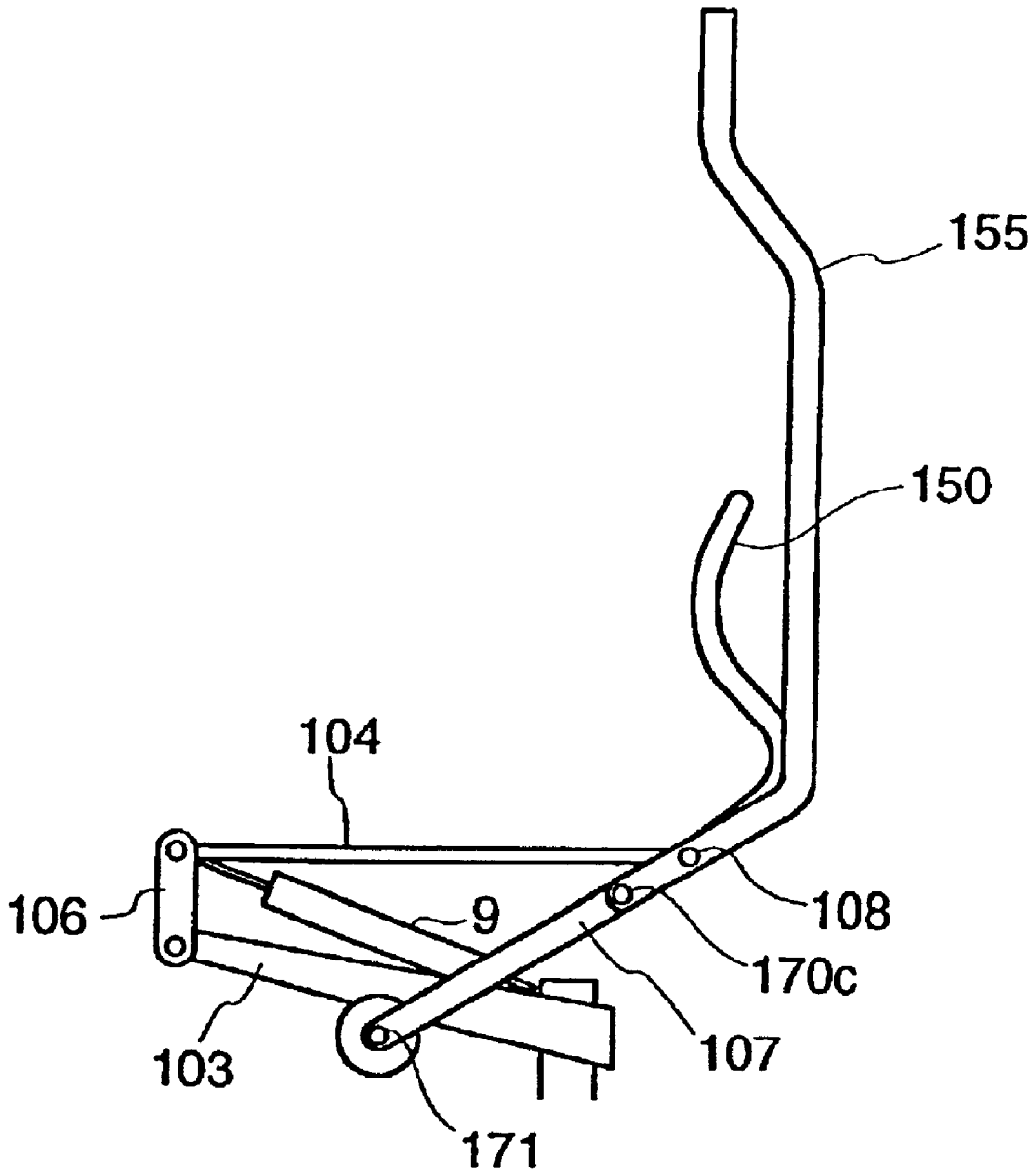
FIG. 7 is a side view of the chair in an upright position according to the second embodiment.
Figure 8:
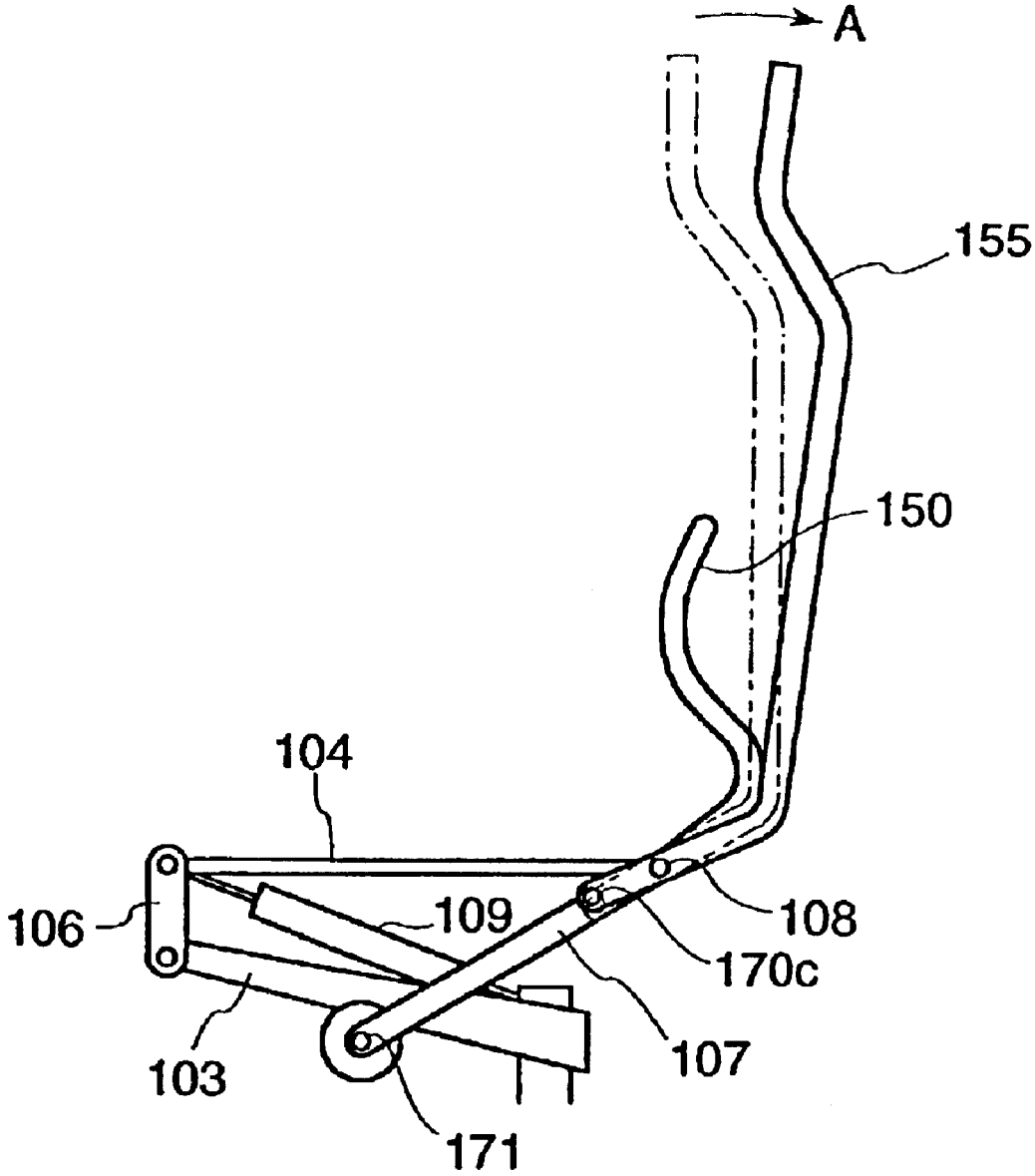
FIG. 8 is a side view showing a first state of the chair according to the second embodiment.
Figure 9:
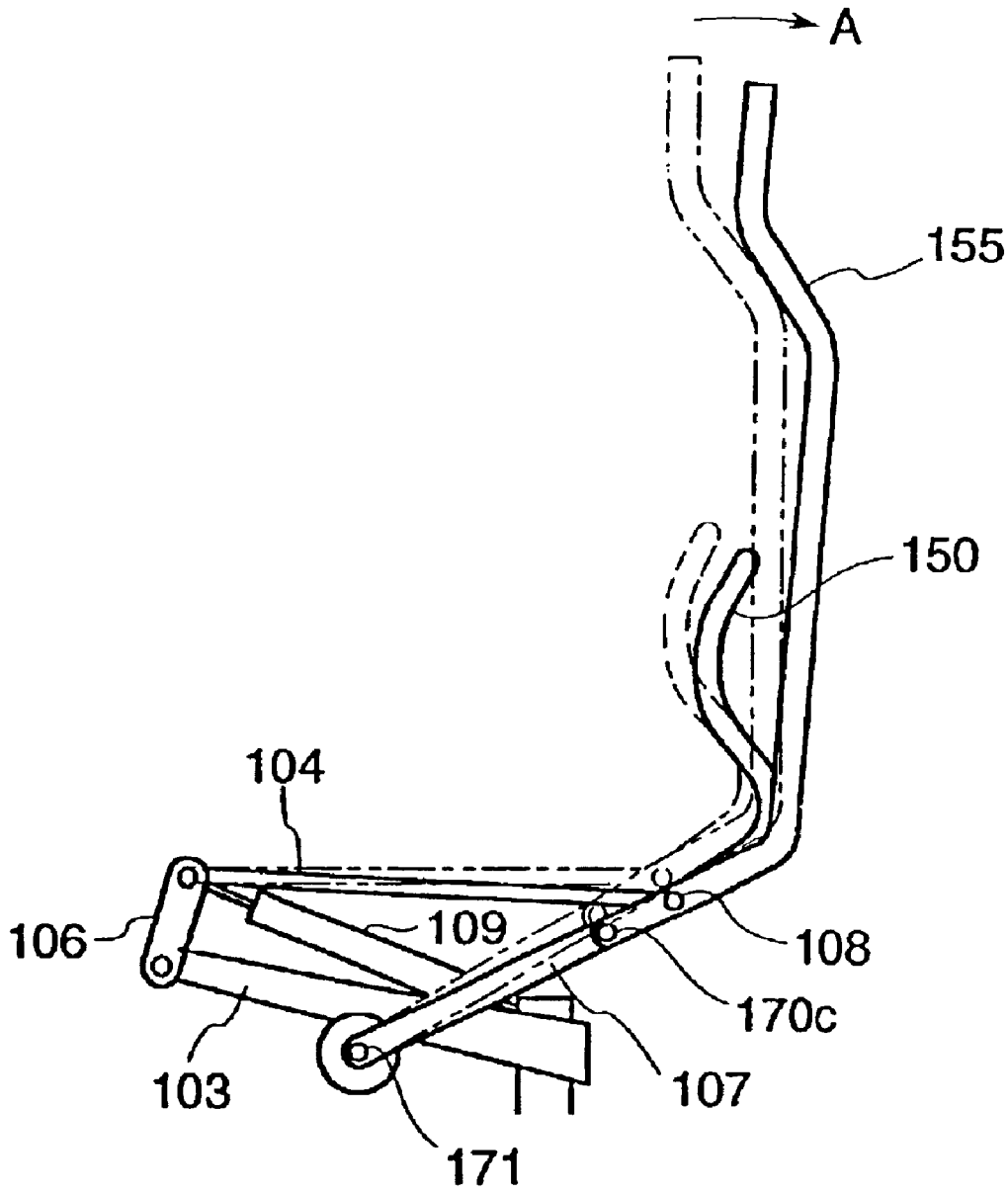
FIG. 9 is a side view showing a second state of the chair according to the second embodiment.

The backrest lower frames 150 and backrest upper frames 155 thus configured are fitted with cantilever elastic pieces not shown having their free ends facing opposite to each other and further with an upholstery member in a manner to embrace the elastic pieces as shown in FIGS. 7 to 9 to form a human body contacting surface of the backrest portion.

Next, description is directed to switching of the state of the backrest of the chair thus constructed. When a first state (shown in FIG. 8) is to be assumed which allows only the backrest upper frames 155 incline rearwardly with the backrest lower frames 150 and the seat frame 104 in an upright position of the chair (shown in FIG. 7) (namely the position in which a person does not sit on the chair and the gas spring is in the free state), the pins 170*a* are pulled out of the respective through-holes 170*c* by turning the lever 170*b* toward one direction with the backrest frames 105 in the upright position not loaded as shown in FIG. 7, while the shaft of the gas cylinder 109 is made stationary to fix the seat frame 104 and backrest lower frames 150. By so doing, only the backrest upper frames 155 become rotatable toward the side A about the shafts 108 located on the upper end side of the links 107, with the result that the backrest upper frames 155 are rearwardly inclined relative to the backrest lower frames 150.

Alternatively, when a second state (shown in FIG. 9) is to be assumed which allows the backrest lower frames 150 and the backrest upper frames 155, as an integral part, to incline rearwardly in the direction A with the seat frame 104 moving interlockingly therewith, the through-holes 170 and the through-holes 170*c* are registered with each other in the upright position of the chair (shown in FIG. 6), namely in the position in which the sitting person does not impose a load on the backrest frame 105, and the lever 170*b* is switched to cause the pins 170*a* to be inserted through the through-holes 170 and 170*c*. At the same time therewith, the gas cylinder 109 is released from the fixed state to allow the seat frame 104 and backrest frame 105 to move freely. By so doing, the backrest upper frames 155 are coupled integrally with the links 107 by means of the pins 170*a* inserted and the shafts 108 and hence become largely rotatable about the shafts 171 located on the lower end side of the links 107. Similarly, the backrest lower frames 150 in a state fixedly screwed to the links 107 become largely rotatable about the shafts 171 in the direction A. Interlockingly with this rotary motion, the seat frame 104 are also inclined while moving rearwardly by means of the links 106 and links 107.

According to this embodiment of the present invention, the pins 170*a* are inserted through the through-holes 170 and 170*c* respectively defined in the backrest upper frames 155 and the links 107 extending in the direction of a downward extension of the backrest upper frames 155, whereby the second state (shown in FIG. 9) is assumed which allows the backrest upper frames 155 and the links 107 to incline rearwardly about the shafts 171 mounted on the support base 103. Alternatively, by pulling the pins 170*a* out of the through holes, the first state (shown in FIG. 8) is assumed which allows only the backrest upper frames 155 to incline rearwardly about the shafts 108 with the backrest lower frames 150 in the fixed state. The chair thus constructed allows a person sitting thereon to relax his or her whole body when the whole backrest portion is stretched, as well as to bend his or her backbone reversely when the upper part of the backrest portion is relatively inclined rearwardly.

It should be noted that though the backrest lower frames 150 are configured to be movable by means of the lifting mechanism 154 in the embodiment, the backrest lower frames 150 may be fixedly integrated with the seat frame 104. Further, though the description of the embodiment has been directed to the case of switching between the first state and the second state with the chair in the upright position, the present invention is not limited to this arrangement and such an arrangement is possible in which with the gas cylinder 109 fixed at a desired angle of rearward inclination backrest upper frames 155 is further inclined rearwardly by withdrawing the pins 170*a*. Alternatively, it is possible that the angle of rearward inclination of the backrest upper frames 155 is caused to decrease depending on the angle of rearward inclination of the backrest lower frames 150.

INDUSTRIAL APPLICABILITY

As has been described, the present invention provides a chair having a backrest portion located behind a seat portion, the backrest portion being divided into an upper part and a lower part, characterized in that the chair is capable of assuming a first state which allows the whole backrest portion to incline rearwardly and a second state which allows the upper part of the backrest portion to incline rearwardly relative to the lower part of the backrest portion, the first state and the second state being switchable to each other. The chair thus constructed allows a person sitting thereon to relax his or her whole body by rearwardly inclining the whole backrest portion as well as to make the upper part of the sitting person's body free by rearwardly inclining the upper part of the backrest portion relative to the lower part of the backrest portion.

The present invention further provides a chair comprising a link member rotatably connected to a support base, a backrest frame rotatably connected to the link member, and a pin removably inserted through holes that are defined in the link member and the backrest frame, respectively, wherein the link member and the backrest frame become rotatable as an integral part when the pin is inserted through the two holes, while when the pin is pulled out of one of the two holes, the backrest frame becomes independently rotatable. The chair of this construction allows a person sitting thereon to relax his or her whole body by rearwardly inclining the whole backrest portion as well as to bend the backbone reversely for refreshing by relatively inclining the upper part of the backrest portion rearwardly.

What is claimed is:

1. A chair having a backrest portion located behind a seat portion, the backrest portion being divided into an upper part for supporting a body part of a person sitting on the chair above the person's waist and a lower part for supporting a body part of the person sitting on the chair adjacent the person's waist, wherein the chair is capable of assuming a first state which allows the whole backrest portion to incline rearwardly and a second state which allows the upper part of the backrest portion to incline rearwardly relative to the lower part of the backrest portion with the lower part of the backrest portion being fixed in an upright position, wherein the first state may be switched to the second state and vice versa.

2. A chair having a backrest portion located behind a seat portion, the backrest portion being divided into an upper part for supporting a body part of a person sitting on the chair above the person's waist and a lower part for supporting a body part of the person sitting on the chair adjacent the person's waist, wherein the chair is capable of switching between a first state which allows the whole backrest portion to incline rearwardly interlockingly with the seat portion and a second state which allows the upper part of the backrest portion to incline rearwardly relative to the lower part of the backrest portion with the lower part of the backrest portion being fixed in an upright position.

* * * * *